US009421755B2

(12) United States Patent
Saad et al.

(10) Patent No.: US 9,421,755 B2
(45) Date of Patent: Aug. 23, 2016

(54) SCREEN PRINTING SYSTEM WITH POSITIONAL ALIGNMENT

(71) Applicants: Muhammad Redzuan bin Saad, Selangor (MY); Zulkifli bin Ambak, Selangor (MY); Mohd Zulfadli bin Mohamed Yusoff, Selangor (MY); Sabrina Binti Mohd Shapee, Selangor (MY); Rosidah bt Alias, Selangor (MY); Azmi bin Ibrahim, Selangor (MY)

(72) Inventors: Muhammad Redzuan bin Saad, Selangor (MY); Zulkifli bin Ambak, Selangor (MY); Mohd Zulfadli bin Mohamed Yusoff, Selangor (MY); Sabrina Binti Mohd Shapee, Selangor (MY); Rosidah bt Alias, Selangor (MY); Azmi bin Ibrahim, Selangor (MY)

(73) Assignee: TELEKOM MALAYSIA BERHAD, Kuala Lumpur (MY)

( * ) Notice: Subject to any disclaimer, the term of this patent is extended or adjusted under 35 U.S.C. 154(b) by 233 days.

(21) Appl. No.: 14/210,964

(22) Filed: Mar. 14, 2014

(65) Prior Publication Data

US 2014/0261027 A1 Sep. 18, 2014

(51) Int. Cl.
*B41F 15/08* (2006.01)
*B41F 15/14* (2006.01)

(52) U.S. Cl.
CPC ..... *B41F 15/0818* (2013.01); *B41P 2215/11* (2013.01); *B41P 2215/114* (2013.01)

(58) Field of Classification Search
CPC ..... B41F 15/08; B41F 15/0813; B41F 33/14
USPC ..... 101/126
See application file for complete search history.

(56) References Cited

U.S. PATENT DOCUMENTS 6,131,511 A * 10/2000 Wachi ..... B41F 15/10 101/126
8,166,875 B2 * 5/2012 Inoue ..... B41F 15/0818 101/126

FOREIGN PATENT DOCUMENTS

JP 2003159778 A * 6/2003

* cited by examiner

*Primary Examiner* — Leslie J Evanisko
(74) *Attorney, Agent, or Firm* — Moore & Van Allen PLLC; Henry B. Ward, III

(57) ABSTRACT

A screen printing system with positional alignment for aligning a substrate with a screen mask. The substrate and the screen mask have two registration holes for facilitating the positional alignment. The positional alignment method includes calculating alignment values for correcting the position of the substrate based on the determined offsets between the registration holes of the substrate and the screen mask. The position of the substrate is corrected based on the calculated alignment values so that registration holes of the substrate are vertically aligned with the registration holes of the screen mask.

32 Claims, 6 Drawing Sheets

SCREEN PRINTING SYSTEM WITH POSITIONAL ALIGNMENT

FIELD OF THE INVENTION

This invention relates to a screen printing system with positional alignment. More particularly, this invention relates a method for aligning substrate with screen mask in a screen printing system.

BACKGROUND OF THE INVENTION

Screen printing apparatuses are known for applying a material (e.g. a conductive paste) on the surface of a substrate (e.g. a print tape) to form a particular printing pattern defined by a screen mask or mesh. Typically, a squeegee is pulled across the top surface of a screen mask and pushes the material applied on the screen mask passes through the pattern holes of the screen mask onto the surface of a substrate positioned below the screen mask. It is a known problem that each time a new substrate is positioned at the printing position or a new screen mask is installed in the printing apparatus, the substrate and the screen mask may not in a perfect alignment and thus resulted in an imprecise printing pattern on the substrate. Therefore, if a high printing accuracy is desired, the position of the substrate or the screen mask has to be corrected before the printing process so that the substrate and the screen mask are aligned with each other.

Many alignment methods have been introduced to improve the printing accuracy and throughput. For example, some recognisable markings are printed on the substrate or the screen mask for facilitating the alignment process. The locations of the markings are measured and compared with an expected location so that positional error can be determined and corrected. Many alignment methods are meant for large scale printing systems and hence their methods are complicated and costly to implement. Although there are simpler alignment methods which can be performed semi-auto or manually, these methods are mostly less accurate and hence not desirable.

Therefore, those skilled in art are constantly striving to devise an alignment method for a screen printing system which is simple and able to provide a high printing accuracy.

SUMMARY OF THE INVENTION

The above other problems are solved and an advance in the art is made by a screen printing system that provides an efficient and accurate method for aligning the substrate with the screen mask. The alignment or compensation values for correcting the position of the substrate are determined based on the offsets between the substrate and the screen mask.

A first advantage of the alignment method in accordance with this invention is that the method reduces the setup time and the alignment time of screen mask/substrate, thereby improving the efficiency and productivity of screen printing. This is because the screen printing system and the alignment method of this invention are relative simple and easy to implement with minimum cost. A second advantage of the alignment method in accordance with this invention is that the method enhances the printing accuracy and quality. This is because the alignment method of this invention has less operational errors since it involves simple mathematical calculations. As a precise alignment of the substrate and the screen mask can be achieved with the method in accordance with this invention, some known problems such as short circuit of the conductive lines printed on the substrate can be avoided.

In accordance with a first aspect of this invention, a method for aligning substrate with screen mask in a screen printing system is provided in the following manner. The method comprises: providing a screen mask which has first and second registration holes through the screen mask; positioning a substrate below and substantially parallel to the screen mask wherein the substrate has first and second registration holes through the substrate; capturing a first image of the first registration holes of the screen mask and the substrate with a first image capturing device wherein the first image shows the first registration hole of the screen mask superimposed with the first registration hole of the substrate; capturing a second image of the second registration holes of the screen mask and the substrate with a second image capturing device wherein the second image shows the second registration hole of the screen mask superimposed with the second registration hole of the substrate; determining from the first and second images whether the first and second registration holes of the substrate are vertically aligned with the first and second registration holes of the screen mask; calculating offsets between the first registration holes from the first image and offsets between the second registration holes from the second image in response to a determination that at least one of the registration holes of the substrate is not vertically aligned with the respective registration hole of the screen mask; calculating alignment values for correcting position of the substrate based on the calculated offsets; and correcting position of the substrate based on the calculated alignment values so that the substrate is vertically aligned with the screen mask.

In accordance with embodiments of this invention, the step of calculating the offsets comprises: measuring differences in distance between the first registration hole of the screen mask and the first registration hole of the substrate in a X axis and a Y axis orthogonal to the X axis wherein the X and Y axes define a horizontal X-Y plane parallel to the screen mask and the substrate; and measuring differences in distance between the second registration hole of the screen mask and the second registration hole of the substrate in the X axis and the Y axis.

In accordance with embodiments of this invention, the step of calculating the alignment values comprises modifying the calculated offsets so that the differences in the X axis and the Y axis between the first registration hole of the screen mask and the first registration hole of the substrate are same as the differences in the X axis and the axis between the second registration hole of the screen mask and the second registration hole of the substrate respectively.

In accordance with embodiments of this invention, the step of modifying the calculated offsets comprises: calculating a X_alignment value by this equation: $(X1+X2)/2$ wherein X1 is the measured difference in the X axis between the first registration holes of the screen mask and the substrate and X2 is the measured difference in the X axis between the second registration holes of the screen mask and the substrate; and calculating a Y_alignment value by this equation: $(Y1+Y2)/2$ wherein Y1 is the measured difference in the Y axis between the first registration holes of the screen mask and the substrate and Y2 is the measured difference in the Y axis between the second registration holes of the screen mask and the substrate.

In accordance with embodiments of this invention, the step of calculating the alignment values further comprises calculating a relative angle between two intersecting line segments (L, L') based on the X_alignment value, the Y_alignment value and the calculated offsets wherein a first one of the intersecting line segments is linearly connecting the first and second registration holes of the screen mask and a second one of the intersecting line segments is linearly connecting the first and second registration holes of the substrate. The relative angle is calculated using a trigonometry formula.

In accordance with embodiments of this invention, the step of correcting position of the substrate comprises moving the substrate laterally along the X axis by the X_alignment value; moving the substrate laterally along the Y axis by the Y_alignment value; rotating the substrate by the relative angle around an axis perpendicular to the X-Y plane wherein the perpendicular axis is at an intersecting point of the two intersecting line segments (L, L'). The intersecting point is a middle point between the first and second registration holes of the screen mask and a middle point between the first and second registration holes of the substrate.

In accordance with embodiments of this invention, the first and second registration holes of the screen mask are being formed at opposite diagonal corner regions of the screen mask. The first and second registration holes of the substrate are being formed at opposite diagonal corner regions of the substrate. In accordance with an embodiment of this invention, the substrate is a low temperature co-fired ceramic tape.

In accordance with a second aspect of this invention, a system for screen printing with alignment of substrate with screen mask is provided in the following manner. The system comprises: a screen mask holder for holding a screen mask wherein the screen mask has first and second registration holes through the screen mask; a substrate holder for receiving a substrate wherein the substrate has first and second registration holes through the substrate; first and second image capturing devices; an alignment system has a processing unit and a memory readable by the processing unit; and instructions stored by the memory that direct the processing unit to: position the substrate holder below the screen mask holder so that the substrate being substantially parallel to the screen mask; capture a first image of the first registration holes of the screen mask and the substrate with the first image capturing device wherein the first image showing the first registration hole of the screen mask superimposed with the first registration hole of the substrate; capture a second image of the second registration holes of the screen mask and the substrate with the second image capturing device wherein the second image showing the second registration hole of the screen mask superimposed with the second registration hole of the substrate; determine from the first and second images whether the first and second registration holes of the substrate are vertically aligned with the first and second registration holes of the screen mask respectively; calculate offsets between the first registration holes from the first image and offsets between the second registration holes from the second image in response to a determination that at least one of the registration holes of the substrate is not vertically aligned with the respective registration hole of the screen mask; calculate alignment values for correcting position of the substrate based on the calculated offsets; and correct position of the substrate based on the calculated alignment values so that the substrate is vertically aligned with the screen mask.

In accordance with embodiments of this invention, the substrate holder is movable laterally along a first axis relative to the screen mask. The substrate holder is movable laterally along a second axis orthogonal to the first axis relative to the screen mask. The substrate holder is rotatable around an axis perpendicular to the screen mask. The screen mask holder is movable vertically relative to the substrate holder.

In accordance with embodiments of this invention, the system further comprises a slidable table on which the substrate holder is mountable wherein the slidable table is movable laterally relative to the screen mask holder. The system further comprises an interface unit in communication with the alignment system wherein the interface unit allows a user to view images and/or enter data. For example, the interface unit is a touch screen.

In accordance with embodiments of this invention, the first and second registration holes of the screen mask are being formed at opposite diagonal corner regions of the screen mask. The first and second registration holes of the substrate are being formed at opposite diagonal corner regions of the substrate. The substrate is a low temperature co-fired ceramic tape.

In accordance with embodiments of this invention, the instructions to calculate the offsets comprise: instructions to measure differences in distance between the first registration hole of the screen mask and the first registration hole of the substrate in a X axis and a Y axis orthogonal to the X axis wherein the X and Y axes define a horizontal X-Y plane parallel to the screen mask and the substrate; and instructions to measure differences in distance between the second registration hole of the screen mask and the second registration hole of the substrate in the X axis and the Y axis.

In accordance with embodiments of this invention, the instructions to calculate the alignment values comprise instructions to modify the calculated offsets so that the differences in the X axis and the Y axis between the first registration hole of the screen mask and the first registration hole of the substrate are same as the differences in the X axis and the Y axis between the second registration hole of the screen mask and the second registration hole of the substrate respectively.

In accordance with embodiments of this invention, the instructions to modify the calculated offsets comprise: instructions to calculate a X_alignment value by this equation: $(X1+X2)/2$ wherein $X1$ is the measured difference in the X axis between the first registration holes of the screen mask and the substrate and $X2$ is the measured difference in the X axis between the second registration holes of the screen mask and the substrate; and instructions to calculate a Y_alignment value by this equation: $(Y1+Y2)/2$ wherein $Y1$ is the measured difference in the Y axis between the first registration holes of the screen mask and the substrate and $Y2$ is the measured difference in the Y axis between the second registration holes of the screen mask and the substrate.

In accordance with embodiments of this invention, the instructions to calculate the alignment values further comprise instructions to calculate a relative angle between two intersecting line segments (L, L') based on the X_alignment value, the Y_alignment value, and the calculated offsets wherein a first one of the intersecting line segments is linearly connecting the first and second registration holes of the screen mask and a second one of the intersecting line segments is linearly connecting the first and second registration holes of the substrate. The relative angle is calculated using a trigonometry formula.

In accordance with embodiments of this invention, the instructions to correct position of the substrate comprise instructions to move the substrate laterally along the X axis by the X_alignment value; instructions to move the substrate laterally along the Y axis by the Y_alignment value; instructions to rotate the substrate by the relative angle around an axis perpendicular to the X-Y plane wherein the perpendicular axis is at an intersecting point of the two intersecting line segments (L, L'). The intersecting point is a middle point between the first and second registration holes of the screen mask and a middle point between the first and second registration holes of the substrate.

BRIEF DESCRIPTION OF THE DRAWINGS

The above and other aspects of this invention will now be described, by way of example only, with reference to the accompany drawings, in which.

DETAILED DESCRIPTION OF THE INVENTION

This invention relates to a screen printing system and a method for aligning the substrate with the screen mask. The alignment values for correcting the position of the substrate are based on the offsets between registration holes of the screen mask and the substrate.

Figure 1:
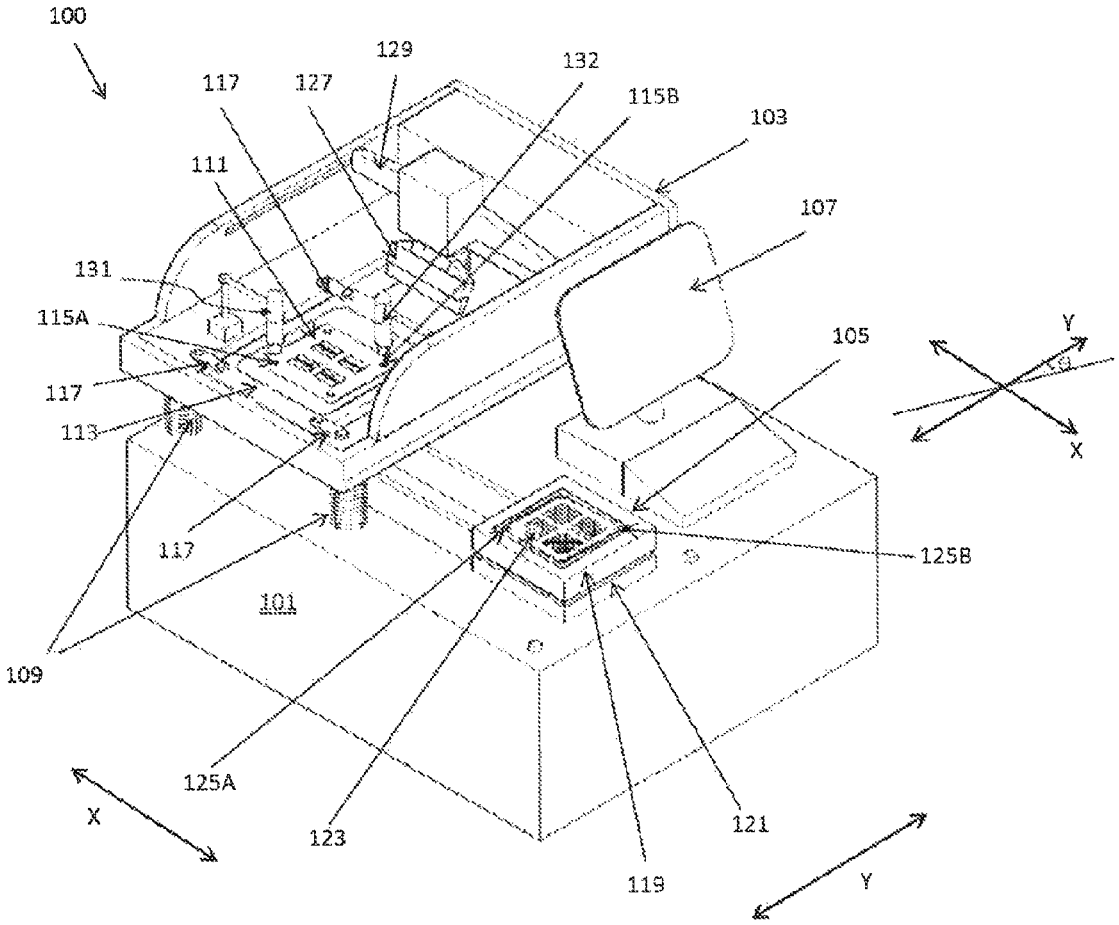
FIG. 1 is a perspective view of a screen printing system according to an embodiment of the invention.
Figure 2:
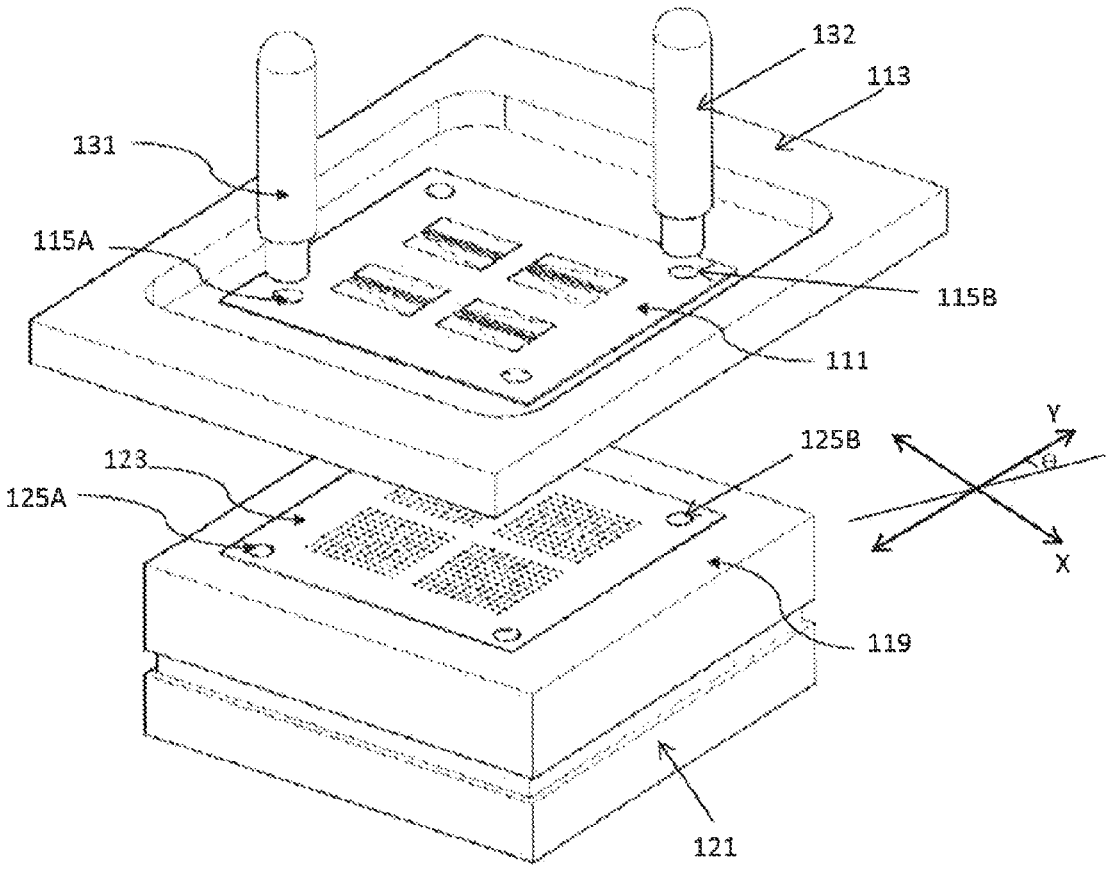
FIG. 2 is an enlarged view of a screen mask holder and a substrate holder in the screen printing system shown in FIG. 1.

FIGS. 1 and 2 show perspective views of a screen printing system 100 in accordance with an embodiment of the invention. Screen printing system 100 has base 101 on which various components are mounted or connected to, including, but not limited to, screen mask station 103, substrate station 105 and input/output unit 107. Base 101 could be the housing for certain hardware and software components, for example processing unit and memory unit of an alignment system of screen printing system 100.

Screen mask station 103 is disposed above base 101 and supported by a plurality of legs 109. Each leg 109 at one end is connected to screen mask station 103 and at the other end is connected to base 101. All of the legs 109 are movable vertically and simultaneously relative to base 101 so that the height of screen mask station 103 can be adjusted. Screen mask station 103 comprises screen mask holder 113 for holding a screen mask 111. Screen mask 111 is a metal plate, preferably in a rectangular shape, having mesh holes defining a printing pattern. Two registration holes 115A, 115B are formed through screen mask 111. Preferably, through holes 115A, 115B are formed at the opposite diagonal corners of screen mask 111. Although two registration holes are described in this application, more holes may be formed in screen mask 111. Through holes 115A, 115B are useful for the alignment process which will be discussed later. Each of the registration holes 115A, 115B has a circular shape (viewing from top) with a diameter of approximately 3 mm. Other shapes of registration hole are possible without departing from this invention. Screen mask holder 113 is removably mounted to screen mask station 103 by locking means, such as locking plate 117 as shown in FIG. 1. Preferably, screen mask holder 113 has a frame-shaped opening in which a screen mask can be attached to. This frame-shaped opening is useful as a screen mask can be installed and replaced easily, without replacing the whole screen mask holder 113.

Substrate station 105 is mounted on base 101 and comprises two components connected to each other, namely substrate holder 119 and slidable table 121. Substrate holder 119 for holding a substrate is mounted on top of slidable table 121 so that movement of slidable table 121 causes substrate holder 119 to move together simultaneously. In a preferred embodiment of the invention, a low temperature co-fired ceramic (LTTC) tape is used as a substrate. However, substrate can be any materials which are suitable for screen printing process. Two registration holes 125A, 125B are formed through substrate 123. Preferably, through holes 125A, 125B are formed at the opposite diagonal corners of substrate 123. Although two registration holes 125A, 125B are described in this application, more holes may be formed in substrate 123. Similar to screen mask 111, each of the registration holes 125A, 125B has a circular shape (viewing from top) with a diameter of approximately 3 mm. Other shapes of registration hole are possible without departing from this invention. In this invention, the size of registration holes 125A, 125B of substrate 123 is substantially same as the size of registration holes 115A, 115B of screen mask 111.

Figure 3A:
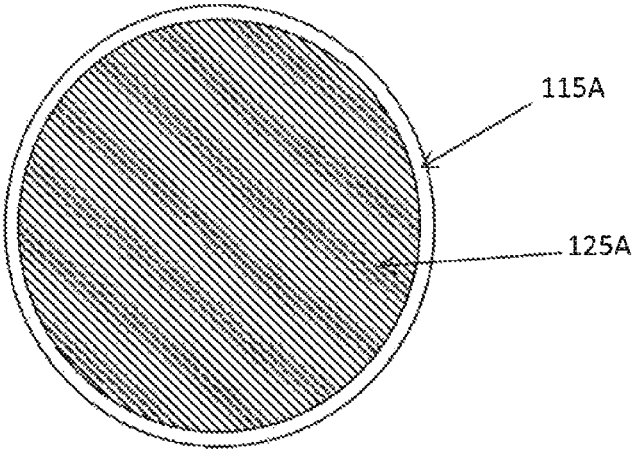
FIG. 3A is a plan view of two perfectly aligned registrations holes of the screen mask and the substrate.
Figure 3B:
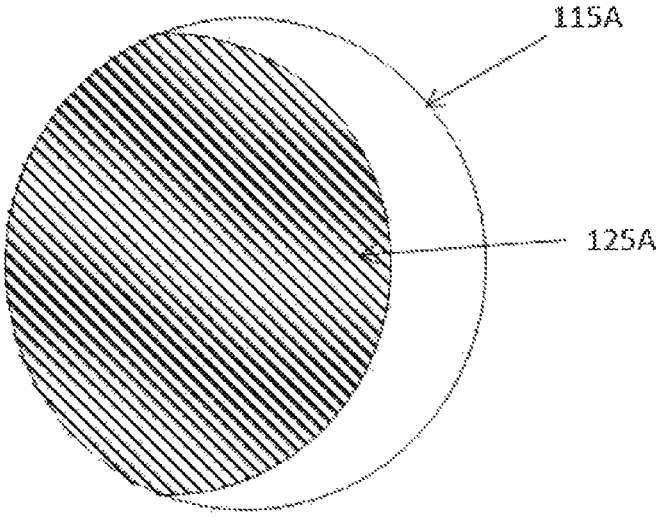
FIG. 3B is a plan view two misaligned registrations holes of the screen mask and the substrate.

Slidable table 121 is movable laterally along a X axis (shown by arrow X in FIGS. 1 and 2) between a loading position and an alignment position. At loading position (see FIG. 1), substrate station 105 is at an access area away from screen mask station 103 so that substrate 123 can be conveniently loaded onto substrate holder 119. At alignment position (see FIG. 2), substrate station 105 is positioned directly below a screen mask held by screen mask holder 113 so that substrate 123 being substantially parallel and adjacent to screen mask 111. If registration holes 125A, 125B of substrate 123 are precisely coincided with registration holes 115A, 115B of screen mask 111 respectively, substrate 123 will be perfectly aligned with screen mask 111. In other words, circular shapes of registration holes 115A, 115B of screen mask 111 are perfectly superimposed on the circular shapes of registration holes 125A, 125B of substrate 123 respectively (see FIG. 3A for an example). If this is the case, substrate 123 may proceed directly to screen printing process. However, if any one (or both) of the registration holes 125A, 1258 of substrate 123 is not precisely coincided with the respective one of the registration holes 115A, 115B of screen mask 111, substrate 123 will be misaligned with screen mask 111. In other words, at least one of the registration holes 115A, 1158 of screen mask 111 is not perfectly superimposed on the respective one of the registration holes 125A, 125B of substrate 123 (see FIG. 3B for an example). If this is the case, the position of substrate 123 has to be adjusted to correct the misalignment before the screen printing process.

The position of substrate holder 119 is independently adjustable in different directions for aligning substrate 123 with screen mask 111. Substrate holder 119 is movable laterally along a X axis (shown by arrow X in FIGS. 1 and 2). Substrate holder 119 is also movable laterally along a Y axis (shown by arrow Y in FIGS. 1 and 2) which is orthogonal to the X axis in the same plane. X and Y axes define a two-dimensional horizontal plane which is referred to as X-Y plane, parallel to screen mask 111 and substrate 123. Further, substrate holder 119 is rotatable (clockwise or anti-clockwise between X and Y axes) in the X-Y plane around an axis perpendicular to the X-Y plane. In other words, substrate holder 119 is rotatable around an axis perpendicular to screen mask 111.

In screen printing station 103, squeegee 127 and a chamber containing a printing material (e.g. conductive paste) are connected to movable plate 129. Movable plate 129 is mounted to screen mask station 103 and is movable to bring the attached squeegee 127 to slide across the top surface of screen mask 111. During printing process, a printing material is dispensed on screen mask 111 and squeegee 127 is made to slide on screen mask 111 to apply the printing material across the surface of screen mask 111. This causes the printing material to pass through the pattern/mesh holes of screen mask 111 onto the printing surface of substrate 123 positioned below screen mask 111.

Two cameras, 131, 132 are attached to screen mask station 103 and disposed above registration holes 115A, 115B of screen mask 111 respectively. Preferably, cameras 131, 132 are positioned directly above and adjacent to registration holes 115A, 115B respectively so that, at alignment position, an image of two superimposed circulars of registration holes (115A superimposed with 125A; 115B superimposed with 125B) of screen mask 111 and substrate 123 can be captured by each camera clearly. These images are useful in positional alignment process in accordance with this invention. Although a camera is described in this application, one skilled in the art will recognise that other image capturing devices can be used.

In accordance with an embodiment of the invention, the position of screen mask 111 is fixed which represents the expected position for printing process. Therefore, the position of substrate 123 has to be aligned with screen mask 111 before a printing process can be carried out. If substrate 123 is aligned with screen mask 111, the image captured by first camera 131 shows two perfectly superimposed (matched) circulars of registration holes 115A, 125A; and the image captured by second camera 132 shows two perfectly superimposed (matched) circulars of registration holes 115B, 125B. See FIG. 3A as an example. If substrate 123 is misaligned with screen mask 111, the image captured by first camera 131 shows two not perfectly superimposed (mismatched) circulars of registration holes 115A, 1254; and/or the image captured by second camera 132 shows two not perfectly superimposed (mismatched) circulars of registration holes 115B, 125B. See FIG. 4B as an example.

Figure 4:
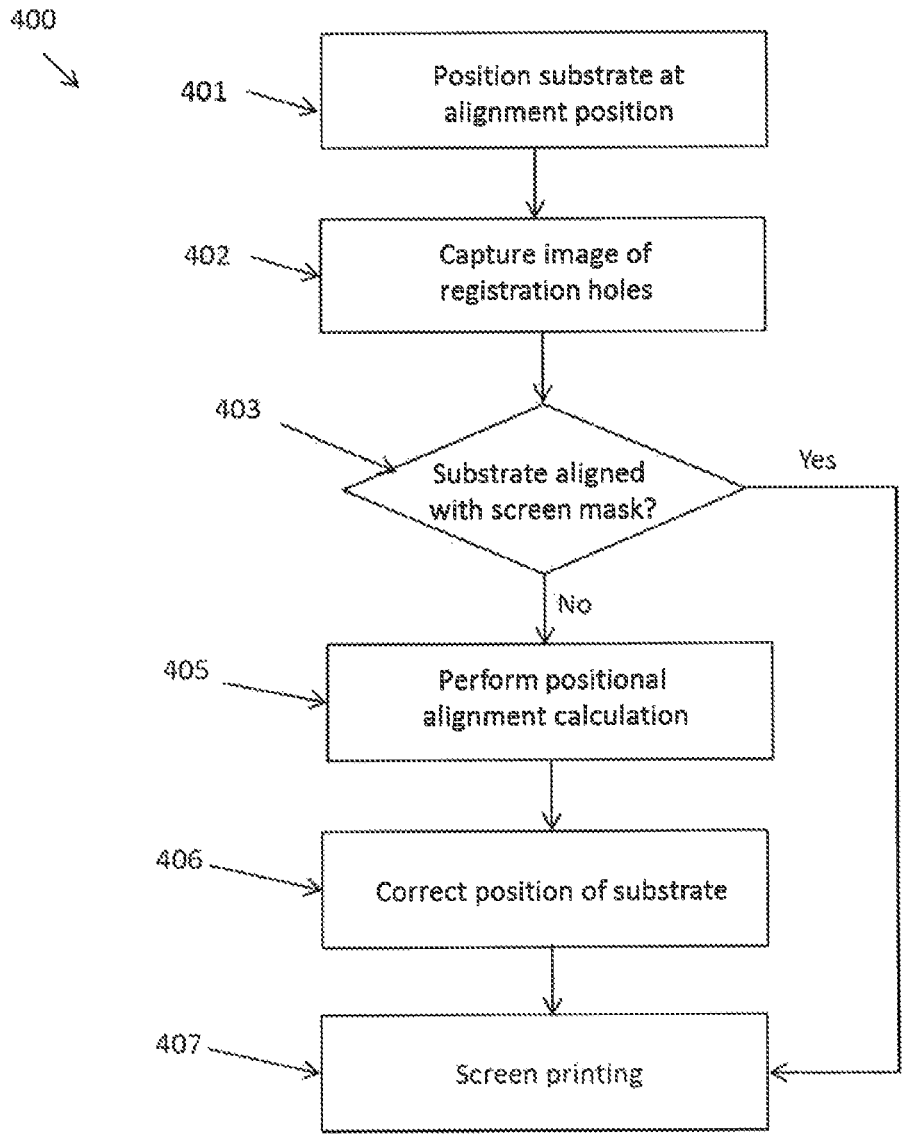
FIG. 4 is a flow chart showing an alignment method of the substrate with the screen mask in according to an embodiment of the invention.

A method for aligning substrate 123 with screen mask 111 automatically by calculating alignment values to correct the position of substrate 123 is described in the following manner and illustrated by a flow chart 400 shown in FIG. 4, in accordance with an embodiment of the invention. A screen mask 111 having two registration holes 115A, 115B is installed in screen mask station 103. In step 401, a substrate 123 having two registration holes 125A, 1258 is placed on substrate station 105 and positioned below screen mask 111 at alignment position. Substrate 123 is substantially parallel and adjacent to screen mask 111. In step 402, first camera 131 is activated to capture an image of first registration holes of screen mask 111 and substrate 123. The image captured by first camera 131 shows two superimposed circulars of first registration holes 115A, 125A. Second camera 132 is also activated to capture an image of second registration holes of screen mask 111 and substrate 123. The image captured by second camera 132 shows two superimposed circulars of second registration holes 115B, 125B.

In step 403, the method determines whether substrate 123 is perfectly aligned with screen mask 111 based on the images captured in step 402. This step is performed by an image processing system. If substrate 123 is perfectly aligned with screen mask 111, two perfectly superimposed circulars of registrations holes is observed from each captured image (i.e. no offset between two superimposed circulars). See FIG. 3A for an example. Hence, substrate 123 may proceed directly to screen printing process in step 407. However, if substrate 123 is misaligned with screen mask 111, at least one of the captured images showing two not perfectly superimposed circulars of registrations holes (i.e. offsets are observed between two superimposed circulars). See FIG. 3B for an example. Hence, the position of substrate 123 has to be corrected so that registration holes 125A, 125B of substrate 123 are vertically aligned with registration holes 115A, 115B of screen mask 111 respectively.

In step 405, positional alignment calculation is performed and alignment values for compensating offsets between the registration holes of substrate 123 and screen mask 111 are determined. The details of step 405 are described in the following manner with reference to FIGS. 5 and 6.

Figure 5A:
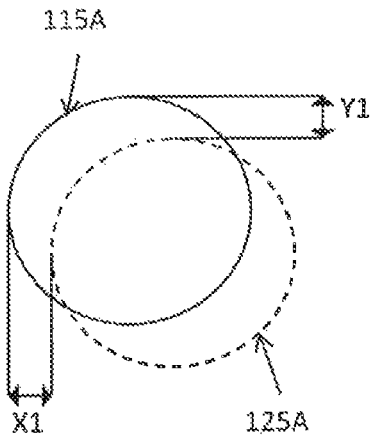
FIG. 5A is a plan view image captured by the first camera showing offsets (X1, Y1) in the X axis and the Y axis of first registration holes of the screen mask and the substrate.
Figure 5B:
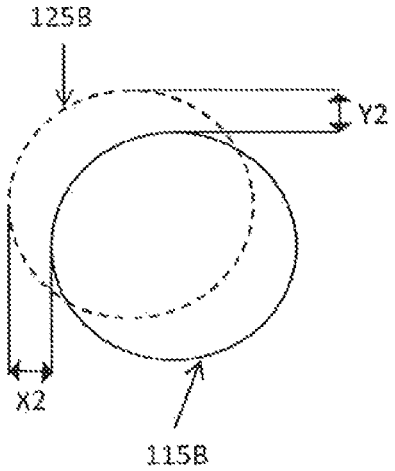
FIG. 5B is a plan view image captured by the second camera showing offsets (X2, Y2) in the X axis and the Y axis of second registration holes of the screen mask and the substrate.
Figure 5C:
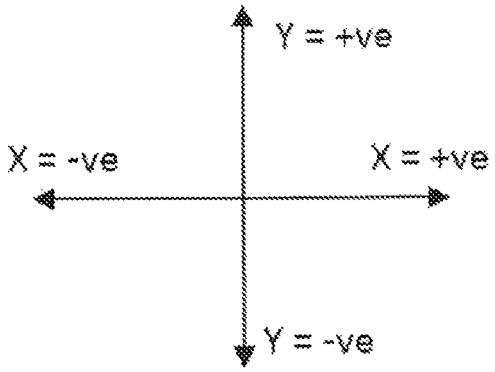
FIG. 5C showing the offset values are determined by the direction of the measurement.

Differences in distance (i.e. offsets) between two superimposed circulars of first registration holes (115A, 125A) of screen mask 111 and substrate 123 with respect to X axis and Y axis are determined by an image processing system based on the image captured by first camera 131 in step 402. These offsets are denoted by 'X1' in X axis and 'Y1 in Y axis as shown in FIG. 5A. Similarly, offsets between two superimposed circulars of second registration holes (115B, 125B) of screen mask 111 and substrate 123 with respect to X axis and Y axis are determined by an image processing system based on the image captured by second camera 132 in step 402. These offsets are denoted by 'X2' in X axis and 'Y2' in Y axis as shown in FIG. 5B. The offset values may be positive or negative depending on the direction of the measurement as shown in FIG. 5C. For example, offsets X1 and X2 are positive values if they are measured in the X-direction from left to right. Conversely, in the opposite direction, i.e. from right to left, X1 and X2 are negative values. Offsets Y1 and Y2 are positive values if they are measured in the Y-direction from bottom to top. Conversely, in the opposite direction, i.e. from top to bottom, Y1 and Y2 are negative values.

Based on the determined offsets X1, Y1, X2 and Y2, mean value of X1 and X2 (denoted by 'X_alignment') and mean value of Y1 and Y2 (denoted by 'Y_alignment') are calculated using the following equations:

$$X_\text{alignment}=(X1+X2)/2,\ Y_\text{alignment}=(Y1+Y2)/2$$

Subsequently, offsets X1, Y1, X2 and Y2 are being modified to X1', Y1', X2' and Y2' respectively using the following equations:

$$X1'=X1-X_\text{alignment},\ Y1'=Y1-Y_\text{alignment}$$

$$X2'=X2-X_\text{alignment},\ Y2'=Y2-Y_\text{alignment}$$

Figure 6:
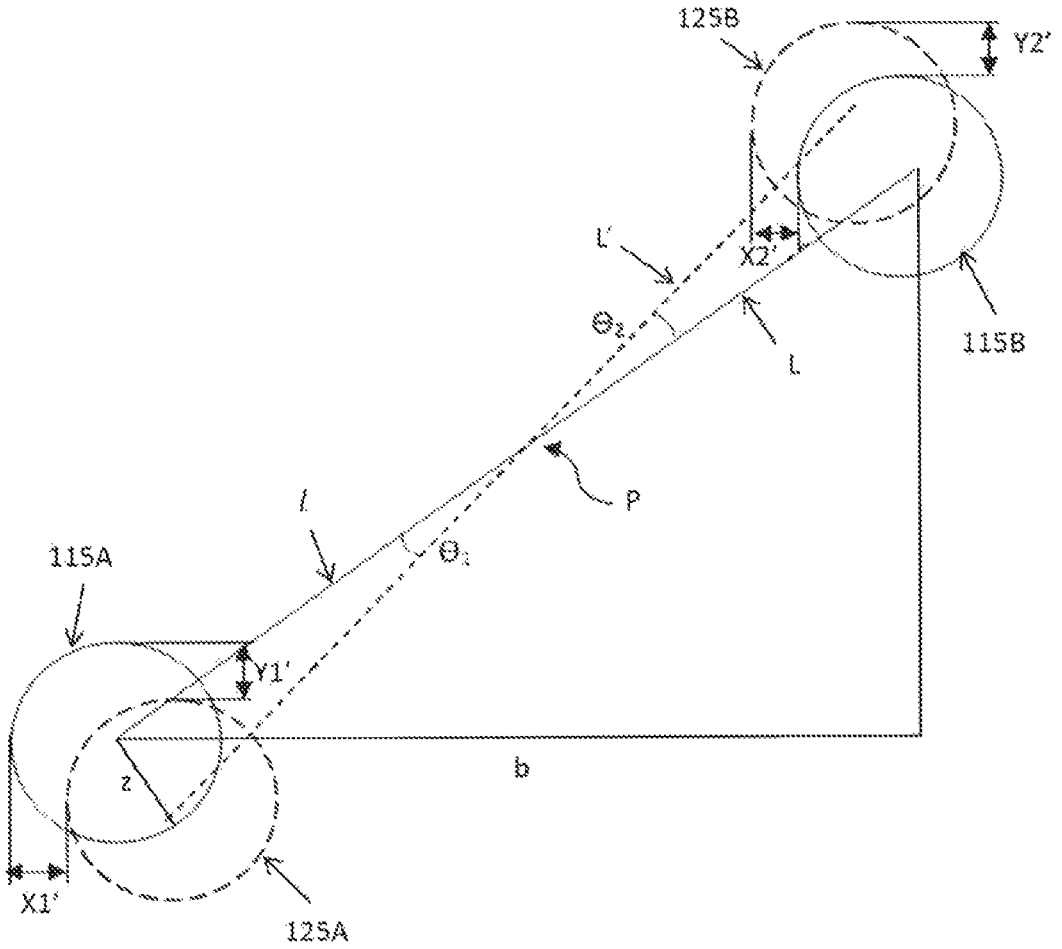
FIG. 6 is an illustration showing the modified offsets of the registration holes of the screen mask and the substrate.

The purpose of modifying the offset values is to ensure that the offsets in X and Y axes between the first registration holes 115A, 125A are same as the offsets in X and Y axes between the second registration holes 115B, 125B, i.e. magnitudes of X1' and Y1' are same as magnitudes of X2' and Y2' respectively. Therefore, if X1'=X2' and Y1'=Y2', the line L connecting the first and second registration holes 115A, 115B of screen mask 111 and line L' connecting the first and second registration holes 125A, 125B of substrate 123 will intersect at an intersecting point P (see FIG. 6) which is the middle point of line L and line L'. As a result of the offset modification, line L is deviated from line L' by a relative angle θ in X-Y plane, and θ=θ1=θ2 as shown in FIG. 6. A rotation of the substrate around point P in X-Y plane by an angle θ will result in line L coincides with line L', in which first and second registration holes 125A, 125B of substrate 123 are perfectly aligned with first and second registration holes 115A, 115B of screen mask 111. Therefore, positional alignment of substrate 123 is accomplished and substrate 123 is ready for printing process in step 407. Relative angle θ is determined by the following equation:

$$\theta = \cos^{-1}\left(\frac{l^2 + l^2 - z^2}{2ll}\right)$$

where l is the half distance of L (or L' since L'=L), i.e. distance between the intersecting point P and the first registration hole or second registration hole of screen mask 111 (or substrate 123). l is a predetermined value that can be calculated with the equation $\sqrt{a^2+b^2}/2$, where a is the distance between the first and second registration holes of screen mask 111 (or substrate 123) along the Y axis, and b is the distance between the first and second registration holes of screen mask 111 (or substrate 123) along the X axis. z is the distance between the center point of the first (or second) circular registration hole of screen mask 111 and the center point of the first (or second) circular registration hole of substrate 123. See FIG. 6. The value of z can be calculated with the equation $$\sqrt{X1'^2+Y1'^2} \text{ (or } \sqrt{X2'^2+Y2'^2}\text{)}.$$

At step 406, the position of substrate 123 is corrected based on the calculated alignment values in step 405. Substrate 123 is arranged to move laterally along the X axis by the calculated X_alignment and move laterally along the Y axis by the calculated Y_alignment. These movements ensure that the offsets in X and Y axes between the first registration holes 115A, 125A are same as the offsets in X and Y axes between the second registration holes 115B, 125B. After that, substrate 123 is arranged to rotate around an axis perpendicular to X-Y plane by the calculated relative angle θ. As such, substrate 123 will be vertically aligned with screen mask 111.

At the stage where substrate 123 is perfectly aligned with screen mask 111, screen printing process on substrate 123 will begin in step 407. An optional step may be implemented between step 406 and 407 to check if the positional alignment of substrate 123 is successful. In this optional step, images of the registration holes will be captured similar to step 402 and determined whether substrate 123 is perfectly aligned with screen mask 111 before proceeding to screen printing process in step 407. If substrate 123 is not properly aligned with screen mask 111, alignment process may be activated and steps 405 and 406 are repeated.

While preferred embodiments of the present invention have been described and illustrated above, it is to be understood that they are exemplary of the invention and are not to be considered to be limiting. It is expected that those skilled in the art can and will design alternative embodiments that infringe this invention as set forth in the following claims.

What is claimed is:

1. A method for aligning a substrate with a screen mask in a screen printing system, the method comprising:

providing a screen mask (111) having first and second registration holes (115A, 115B) through the screen mask (111);

positioning a substrate (123) below and substantially parallel to the screen mask (111), the substrate (123) having first and second registration holes (125A, 125B) through the substrate (123);

capturing a first image of the first registration holes (115A, 125A) of the screen mask (111) and the substrate (123) with a first image capturing device (131), wherein the first image shows the first registration hole (115A) of the screen mask (111) superimposed with the first registration hole (125A) of the substrate (123);

capturing a second image of the second registration holes (115B, 125B) of the screen mask (111) and the substrate (123) with a second image capturing device (132), wherein the second image shows the second registration hole (115B) of the screen mask (111) superimposed with the second registration hole (125B) of the substrate (123);

determining from the first and second images whether the first and second registration holes (125A, 125B) of the substrate (123) are vertically aligned with the first and second registration holes (115A, 115B) of the screen mask (111) respectively;

calculating offsets between the first registration holes (115A, 125A) from the first image and offsets between the second registration holes (115B, 125B) from the second image in response to a determination that at least one of the registration holes (125A, 125B) of the substrate (123) is not vertically aligned with the respective registration hole (115A, 115B) of the screen mask (111);

calculating alignment values for correcting position of the substrate (123) based on the calculated offsets; and correcting position of the substrate (123) based on the calculated alignment values so that the substrate (123) is vertically aligned with the screen mask (111).

2. The method of claim 1 wherein the step of calculating the offsets comprises:

measuring differences in distance between the first registration hole (115A) of the screen mask (111) and the first registration hole (125A) of the substrate (123) in a X axis and a Y axis orthogonal to the X axis wherein the X and Y axes define a horizontal X-Y plane parallel to the screen mask (111) and the substrate (123); and measuring differences in distance between the second registration hole (115B) of the screen mask (111) and the second registration hole (125B) of the substrate (123) in the X axis and the Y axis.

3. The method of claim 2, wherein the step of calculating the alignment values comprises:

modifying the calculated offsets so that the differences in the X axis and the Y axis between the first registration hole (115A) of the screen mask (111) and the first registration hole (125A) of the substrate (123) are the same as the differences in the X axis and the Y axis between the second registration hole (115B) of the screen mask (111) and the second registration hole (125B) of the substrate (123) respectively.

4. The method of claim 3, wherein the step of modifying the calculated offsets comprises:

calculating an X_alignment value by this equation: (X1+X2)/2, wherein X1 is the measured difference in the X axis between the first registration holes (115A, 125A) of the screen mask (111) and the substrate (123) and X2 is the measured difference in the X axis between the second registration holes (115B, 125B) of the screen mask (111) and the substrate (123); and calculating a Y_alignment value by this equation: (Y1+Y2)/2, wherein Y1 is the measured difference in the Y axis between the first registration holes (115A, 125A) of the screen mask (111) and the substrate (123) and Y2 is the measured difference in the Y axis between the second registration holes (115B, 125B) of the screen mask (111) and the substrate (123).

5. The method of claim 4 wherein the step of calculating the alignment values further comprises:

calculating a relative angle between two intersecting line segments (L, L') based on the X_alignment value, the Y_alignment value and the calculated offsets wherein a first one of the intersecting line segments is linearly connecting the first and second registration holes (115A, 115B) of the screen mask (111) and a second one of the intersecting line segments is linearly connecting the first and second registration holes (125A, 125B) of the substrate (123).

6. The method of claim 5 wherein the relative angle is calculated using a trigonometry formula.

7. The method of claim 4 wherein the step of correcting position of the substrate (123) comprises:

moving the substrate (123) laterally along the X axis by the X_alignment value.

8. The method of claim 4 wherein the step of correcting position of the substrate (123) comprises:

moving the substrate (123) laterally along the Y axis by the Y_alignment value.

9. The method of claim 5 wherein the step of correcting position of the substrate (123) comprises:

rotating the substrate (123) by the relative angle around an axis perpendicular to the X-Y plane wherein the perpendicular axis is at an intersecting point of the two intersecting line segments (L, L').

10. The method of claim 9 wherein the intersecting point is a middle point between the first and second registration holes (115A, 115B) of the screen mask (111) and a middle point between the first and second registration holes (125A, 125B) of the substrate (123).

11. The method of claim 1 wherein the first and second registration holes (115A, 115B) of the screen mask (111) are being formed at opposite diagonal corner regions of the screen mask (111).

12. The method of claim 1 wherein the first and second registration holes (125A, 125B) of the substrate (123) are being formed at opposite diagonal corner regions of the substrate (123).

13. The method of claim 1 wherein the substrate (123) is a low temperature co-fired ceramic tape.

14. A system (100) for screen printing with alignment of a substrate with a screen mask, the system (100) comprising:

a screen mask holder (113) for holding a screen mask (111), the screen mask (111) having first and second registration holes (115A, 115B) through the screen mask (111);

a substrate holder (119) for receiving a substrate (123), the substrate (123) having first and second registration holes (125A, 125B) through the substrate (123);

first and second image capturing devices (131, 132);

an alignment system having a processing unit and a memory readable by the processing unit; and instructions stored by the memory that direct the processing unit to:

position the substrate holder (119) below the screen mask holder (113) so that the substrate (123) is substantially parallel to the screen mask (111);

capture a first image of the first registration holes (115A, 125A) of the screen mask (111) and the substrate (123) with the first image capturing device (131), wherein the first image shows the first registration hole (115A) of the screen mask (111) superimposed with the first registration hole (125A) of the substrate (123);

capture a second image of the second registration holes (115B, 125B) of the screen mask (111) and the substrate (123) with the second image capturing device (132), wherein the second image shows the second registration hole (115B) of the screen mask (111) superimposed with the second registration hole (125B) of the substrate (123);

determine from the first and second images whether the first and second registration holes (125A, 125B) of the substrate (123) are vertically aligned with the first and second registration holes (115A, 115B) of the screen mask (111) respectively;

calculate offsets between the first registration holes (115A, 125A) from the first image and offsets between the second registration holes (115B, 125B) from the second image in response to a determination that at least one of the registration holes (125A, 125B) of the substrate (123) is not vertically aligned with the respective registration hole (115A, 115B) of the screen mask (111);

calculate alignment values for correcting position of the substrate (123) based on the calculated offsets; and correct position of the substrate (123) based on the calculated alignment values so that the substrate (123) is vertically aligned with the screen mask (111).

15. The system of claim 14 wherein the substrate holder (119) is movable laterally along a first axis relative to the screen mask (111).

16. The system of claim 15 wherein the substrate holder (119) is movable laterally along a second axis orthogonal to the first axis relative to the screen mask (111).

17. The system of claim 14 wherein the substrate holder (119) is rotatable around an axis perpendicular to the screen mask (111).

18. The system of claim 14 wherein the screen mask holder (113) is movable vertically relative to the substrate holder (119).

19. The system of claim 14 further comprising:

a slidable table (121) on which the substrate holder (119) is mountable wherein the slidable table (121) is movable laterally relative to the screen mask holder (113).

20. The system of claim 14 further comprising:

an interface unit (107) in communication with the alignment system wherein the interface unit (107) allows a user to view images and/or enter data.

21. The system of claim 14 wherein the first and second registration holes (115A, 115B) of the screen mask (111) are being formed at opposite diagonal corner regions of the screen mask (111).

22. The system of claim 14 wherein the first and second registration holes (125A, 125B) of the substrate (123) are being formed at opposite diagonal corner regions of the substrate (123).

23. The system of claim 14 wherein the substrate (123) is a low temperature co-fired ceramic tape.

24. The system of claim 14 wherein the instructions to calculate the offsets comprise:

instructions to measure differences in distance between the first registration hole (115A) of the screen mask (111) and the first registration hole (125A) of the substrate (123) in a X axis and a Y axis orthogonal to the X axis wherein the X and Y axes define a horizontal X-Y plane parallel to the screen mask (111) and the substrate (123); and instructions to measure differences in distance between the second registration hole (115B) of the screen mask (111) and the second registration hole (125B) of the substrate (123) in the X axis and the Y axis.

25. The system of claim 24 wherein the instructions to calculate the alignment values comprise:

instructions to modify the calculated offsets so that the differences in the X axis and the Y axis between the first registration hole (115A) of the screen mask (111) and the first registration hole (125A) of the substrate (123) are same as the differences in the X axis and the Y axis between the second registration hole (115B) of the screen mask (111) and the second registration hole (125B) of the substrate (123) respectively.

26. The system of claim 25 wherein the instructions to modify the calculated offsets comprise:

instructions to calculate a X_alignment value by this equation: (X1+X2)/2 wherein X1 is the measured difference in the X axis between the first registration holes (115A, 125A) of the screen mask (111) and the substrate (123) and X2 is the measured difference in the X axis between the second registration holes (115B, 125B) of the screen mask (111) and the substrate (123); and instructions to calculate a Y_alignment value by this equation: (Y1+Y2)/2 wherein Y1 is the measured difference in the Y axis between the first registration holes (115A, 125A) of the screen mask (111) and the substrate (123) and Y2 is the measured difference in the Y axis between the second registration holes (115B, 125B) of the screen mask (111) and the substrate (123).

27. The system of claim 26, wherein the instructions to calculate the alignment values further comprise:

instructions to calculate a relative angle between two intersecting line segments (L, L') based on the X_alignment value, the Y_alignment value, and the calculated offsets wherein a first one of the intersecting line segments is linearly connecting the first and second registration holes (115A, 115B) of the screen mask (111) and a second one of the intersecting line segments is linearly connecting the first and second registration holes (125A, 125B) of the substrate (123).

28. The system of claim 27, wherein the relative angle is calculated using a trigonometry formula.

29. The system of claim 26, wherein the instructions to correct position of the substrate (123) comprise:

instructions to move the substrate (123) laterally along the X axis by the X_alignment value.

30. The system of claim 26, wherein the instructions to correct position of the substrate (123) comprise:

instructions to move the substrate (123) laterally along the Y axis by the Y_alignment value.

31. The system of claim 27, wherein the instructions to correct position of the substrate (123) comprise:

instructions to rotate the substrate (123) by the relative angle around an axis perpendicular to the X-Y plane wherein the perpendicular axis is at an intersecting point of the two intersecting line segments (L, L').

32. The system of claim 31 wherein the intersecting point is a middle point between the first and second registration holes (115A, 115B) of the screen mask (111) and a middle point between the first and second registration holes (125A, 125B) of the substrate (123).

* * * * *